United States Patent [19]

Cusumano et al.

[11] 4,352,445

[45] Oct. 5, 1982

[54] BUILDING MATERIAL APPLICATOR

[76] Inventors: Philip Cusumano, 246-25 137th Ave.; Vincent Cusumano, 246-26 137th Ave., both of Rosedale, N.Y. 11422

[21] Appl. No.: 133,660

[22] Filed: Mar. 24, 1980

[51] Int. Cl.[3] ..... B05D 1/26; B05D 1/30; F04G 21/16

[52] U.S. Cl. ..... 222/611; 52/749; 222/613; 401/193

[58] Field of Search ..... 52/749; 294/3.5, 16, 294/15; 222/611, 624, 613, 614; 401/193, 4, 48; 249/18

[56] References Cited

U.S. PATENT DOCUMENTS

| | | | |
|---|---|---|---|
| 2,341,691 | 2/1944 | Ciceske | 222/611 |
| 2,683,981 | 7/1954 | Richey | 401/193 |
| 3,093,936 | 6/1963 | Figge | 52/749 |
| 3,148,432 | 9/1964 | Garnett | 222/611 |
| 3,325,960 | 6/1967 | James | 52/749 |
| 3,791,559 | 2/1974 | Foye | 222/611 |
| 3,831,819 | 8/1974 | Bloom | 222/611 |
| 3,885,315 | 5/1975 | Polselli | 401/193 |
| 4,135,651 | 1/1979 | Hession | 222/611 |

FOREIGN PATENT DOCUMENTS

| | | | |
|---|---|---|---|
| 975140 | 6/1973 | Canada | 52/749 |
| 240352 | 10/1925 | United Kingdom | 52/749 |

*Primary Examiner*—John E. Murtagh

*Attorney, Agent, or Firm*—Kane, Dalsimer, Kane, Sullivan & Kurucz

[57] ABSTRACT

An applicator for introducing and spreading building material in a controlled manner to a building surface. The device includes a housing adapted to contain a predetermined amount of building material therein. Guides are on the housing adapted to engage with the building surface and direct the applicator into desired alignment with the building surface and to direct the applicator along a predetermined path when the applicator is associated with the building surface and moved there along. A metering structure communicates with the interior of the housing and with at least one opening to the exterior thereof to direct a predetermined pattern of building material from the interior of the housing through the opening and onto the building surface. The applicator is particularly useful in applying and spreading mortar to bind an arrangement of rows of concrete blocks.

14 Claims, 8 Drawing Figures

BUILDING MATERIAL APPLICATOR

BACKGROUND OF THE INVENTION

In the building industry it has been the common practice for many years to construct foundations, interior and exterior wall structures of concrete blocks arranged in rows and held together by mortar. Also, in many related building environments it is conventional to use a bonding medium, such as mortar, to hold together elements of structure, such as concrete blocks. In most cases, it is a time consuming process to manually apply the mortar or similar bonding agent to each row of concrete blocks or similar work surface by means of a trowel or similar hand implement. The conventional procedure is to scoop the mortar onto the working surface and then spread the mortar by hand using a hand implement. In addition to the time required this procedure is also wasteful. Mortar is lost as unequal amounts are applied indiscriminately and spread along the surface of the concrete blocks. This is often aggrivated by the worker's haste in manually applying the mortar in order to complete the job as soon as possible.

Thus, the need for a device to butter building structures such as concrete block in a more efficient and economical way with mortar or similar bonding material. A device which eliminates the problem of mortar waste and provides a quick and efficient manner of applying mortar to the concrete block arrangement or other building surface is certainly a desirable improvement. Naturally the automatic application device should be of low cost and easily manufactured, assembled and used. It should be usable in a quick and efficient manner to automatically apply mortar in controlled predetermined amounts to a chosen location on a work surface.

SUMMARY OF THE INVENTION

With the above background in mind, it is among the primary objectives of the present invention to provide a hand-size applicator designed to be quickly and efficiently aligned with a work surface, such as a row of concrete blocks, and moved along that surface on a guided path to automatically meter out predetermined amounts of mortar or similar building material to predetermined locations on the work surface. In this manner, the mortar or similar material is quickly and efficiently applied automatically in the desired amount. Thereafter, concrete blocks or similar building structures can be applied in a continuation of the building process.

The applicator is designed so that it can be quickly and efficiently indexed on a row of blocks forming a work surface for application of material such as mortar. Thereafter, the application is moved smoothly along the row of blocks and automatically a predetermined amount of mortar or similar material is metered from the applicator onto the surface of the blocks. Mortar waste is eliminated since the next row of blocks can be immediately applied to the surface containing the mortar to continue the building process. There is no need for removal of excess mortar or redistribution of mortar on the surface.

The applicator of the present device employs a mortar dividing blade to distribute and direct mortar through discharge openings in the applicator as it is moved along the work surface. In one embodiment there are two discharge openings spaced on the trailing edge to provide for two uniform rows of motar continuously discharged from the applicator. The device is designed so that a suitable beater is employed to assist in discharging the mortar from the applicator in a desired manner as the applicator is moved along the work surface.

It is also an objective to provide a unitary applicator structure including a housing having an access opening for introduction of a desired supply amount of building material to an interior chamber. A divider directs the mortar toward two discharge openings in the trailing end of the applicator at spaced points across the transverse surface of the blocks along which the applicator is moved in a longitudinal direction. A suitable handle is provided on the applicator for assisting in handling the device in use. The applicator is designed with suitable runner wheels to assist in longitudinal movement of the applicator along the work surface.

Furthermore, the applicator is provided with guide wheels to capture a block therebetween and provide for indexing and alignment of the applicator on the block surface so that the metered mortar or like building material is applied at the desired location on the block arrangement.

Another form of the applicator employs a housing with side walls converging toward one another from top to bottom to provide a funnel shaped enclosure for a chamber to hold the building material. The side walls direct the material toward one or more openings adjacent the bottom of the housing. A beater arrangement is utilized which employs an axle bent into a configuration to form one or more paddles within the housing in alignment with the openings therein to facilitate direction of building material through the openings. The beater axle is driven by an arrangement of gears which in turn is driven by a roller extending downward from the housing to engage a surface adjacent to the building surface and rotate as the applicator is moved along the building surface. Rotation of the roller rotates the axle through the gear arrangement and the paddle configuration of the axle directs the building materials through the openings onto the building surface.

It is a further objective to provide an applicator which is of unitary construction, is formed of inexpensive material and can be used quickly and efficiently for the automatic distribution of desired amounts of building material such as mortar to a building surface such as an arrangement of concrete blocks. It is designed and formed of inexpensive material and is lightweight for ease of handling in use.

In summary, an applicator for introducing and spreading building material in a controlled manner to a building surface is provided. The applicator includes a housing adapted to contain a predetermined amount of building material therein. Guide means is on the housing adapted to engage with the building surface and direct the applicator into desired alignment therewith and along a predetermined path when the applicator is associated with a building surface and moved there along. Metering means is in communication with the interior of the housing and with at least one opening to the exterior thereof to direct a predetermined pattern of building material from the interior of the housing through the opening and onto the building surface.

With the above objectives among others in mind, reference is made to the attached drawings.

DETAILED DESCRIPTION

Figure 1:
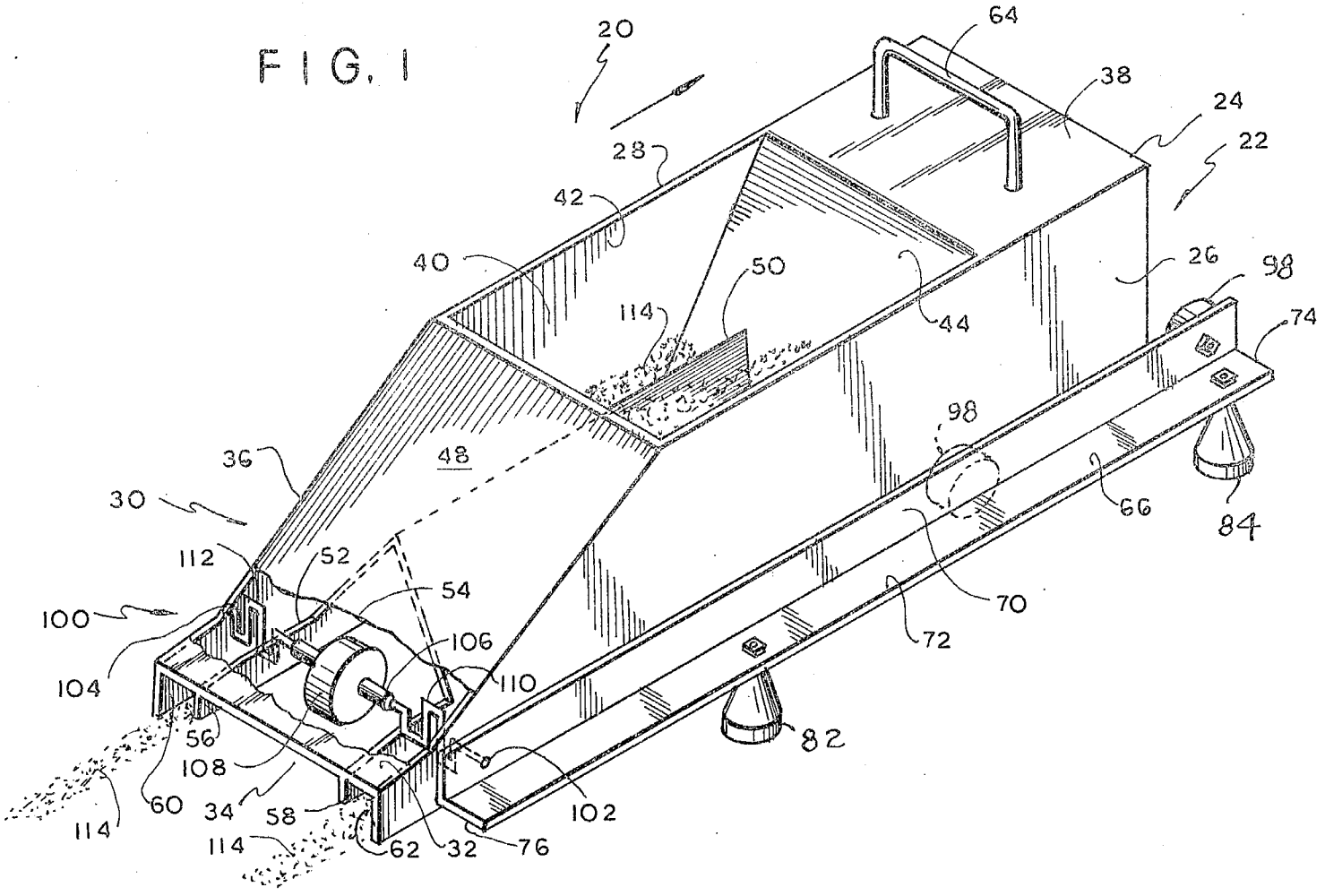
FIG. 1 is a perspective view of the applicator of the invention.

Applicator 20 is formed with a housing 22. The housing includes a vertical leading end wall 24 with a pair of opposing longitudinal side walls 26 and 28 and a trailing wall 30. Trailing wall 30 has a lower mouth portion 32 to form an opening 34 and an upper tapered portion 36. The interconnected walls forms a substantially rectangular shaped housing 22. A top wall 38 extends partially over the upper surface of housing 22. The remainder of the upper surface is formed with an opening 40 providing an entrance to an interior chamber 42. The inner surface of tapered portion 36 of the trailing wall, the inner surface of opposing sides 26 and 28 and a tapered intermediate wall 44 of the housing form the walls for chamber 42. The portion of housing 22 between tapered intermediate wall 44 and leading end wall 24 is sealed by a bottom wall 46. The bottom of chamber 42 is formed by a V-shaped divider blade 48. The apex 50 of the divider blade 48 extends upward into chamber 42 and in a longitudinal direction. It terminates at the inner surface of tapered portion 36 of trailing wall 30 at one end and at tapered intermediate wall 44 in the other direction. It is mounted in conventional fashion such as by welding or can be formed unitary with the interconnected portion of the housing. The divider blade 48 has its two sides 52 and 54 extending downwardly and outwardly away from apex 50 to terminate in longitudinal flanges 56 and 58 respectively. Flanges 56 and 58 are spaced from side walls 28 and 26 respectively thereby providing channels 60 and 62 therebetween respectively. These channels 60 and 62 are opened at opening 34 of mouth 32 at the trailing end of the housing. This provides a pair of spaced communicating passages between the interior chamber 42 and the exterior of the housing.

A handle 64 is mounted on the upper surface 38 of housing 22 and extends upwardly therefrom to facilitate gripping and handling of applicator 20.

A pair of L-shaped side brackets 66 and 68 respectively are affixed to side walls 26 and 28 respectively. The L-shaped brackets extend longitudinally along the side walls and have one leg 70 affixed to the side wall in a conventional manner such as by welding, riveting, bolting or any other well known manner. The other leg 72 of each L-shaped bracket extends at right angles to the leg 70 and outward in a tranverse direction with respect to applicator 20 and longitudinally along the side walls. The leading edge 74 of each L-shaped bracket extends beyond leading wall 24 in the direction of travel and the trailing edge 76 is located adjacent to opening 34 of mouth portion 32 of the trailing wall 30. The brackets 66 and 68 do not extend beyond mouth 32 in the trailing direction.

A pair of spaced vertical axles 78 and 80 are mounted to transverse horizontal leg 72 of each bracket in a conventional manner such as by threading a nut 82 on a threaded end of the axle extending through an appropriate aperture in leg 72. A guide wheel 82 is mounted on the end of axle 78 distal from leg 72 and similarly a second guide wheel 84 is mounted at the end of the axle 80 distal from leg 72. As shown, these wheels lie in a horizontal plane for rotation about the vertical axles 70 and 80. Each of the L-shaped brackets 66 and 68 contains aligned pairs of wheels 82 and 84 which form a guide means for applying the applicator 20 to a work surface. A suitable wheel shield 86 can be mounted in a conventional manner on each of the four shafts to protect the wheels 82 and 84 from damaging blows and from other contaminating substances which could affect operation of the wheels. The number of pairs of wheels and positioning thereof is a matter of choice with two sets of wheels shown in the depicted embodiment. The leading set of wheels are mounted to brackets 66 and 68 on the portion thereof extending forward of leading wall 24. The trailing pair of wheels 82 are mounted in an intermediate position in alignment with a portion of chamber 42.

On each leg 70 of L-shaped brackets 66 and 68 is a horizontal axes 88 extending transversely with respect to the applicator 20 and in alignment with axle 80. Each axle 88 is mounted to leg 70 by means of a conventional fastener such as a threaded nut 90 or other well known means in a similar manner as discussed in connection with axles 78. Inside of leg 70 rotationally mounted on each axle 66 is a runner wheel 92. The pair of runner wheels 92 on the brackets 66 and 68 are aligned with one another and extend downward beyond the bottom edge of housing 22 for engagement with the work surface.

A similar pair of axle and wheel assemblies are spaced from wheels 92 in the rearward direction. Each axle 94 is mounted in the same manner by use of an appropriate threaded nut 96 and a runner wheel 98 is rotationally mounted thereon. The pair of wheels 98 are located in the depicted embodiment just forward of the tapered intermediate wall 44 forming the leading wall of chamber 42. Runner wheels 98 similar to runner wheels 92 extend below the bottom edge of housing 22 for engagement with the work surface.

A beater assembly 100 is mounted adjacent to trailing wall 30. One end portion 102 is rotatably mounted to side wall 26 and leg 70 of bracket 68. The other end portion 104 is rotatably mounted to the opposing side wall 28 and leg 70 of L-shaped bracket 68. The end portions 102 and 104 are interconnected with a locking shaft 106 which in turn has a beater wheel 108 mounted thereon for rotation therewith. The interlocked shaft portions 102, 104, locking shaft 106 and wheel 108 are designed for interconnected rotation. Formed on shaft portion 102 between side wall 26 and locking shaft 106 is a paddle 110. The paddle is in alignment with channel 62 exiting at mouth opening 34. A similar paddle 112 is formed in end portion 104 between side wall 28 and locking shaft 106. Paddle 112 is in alignment with channel 60 exiting at opening 34 of mouth 32. These paddles 110 and 112 can be formed in any conventional manner. In the embodiment shown, they are formed by bending shaft portions 102 and 104. As the beater assembly 100 rotates, the paddles or beaters 110 and 112 will periodically engage with building material contained within chamber 42 and assist in directing it outward through channel 60 and 62. Wheel 108 is large enough to extend downward beyond the bottom edge of housing 22 so that it engages with the building surface and rotates as the applicator is moved along the building surface thereby facilitating beating of the building material by rotating paddles 110 and 112 as the material is metered from the applicator.

Figure 2:
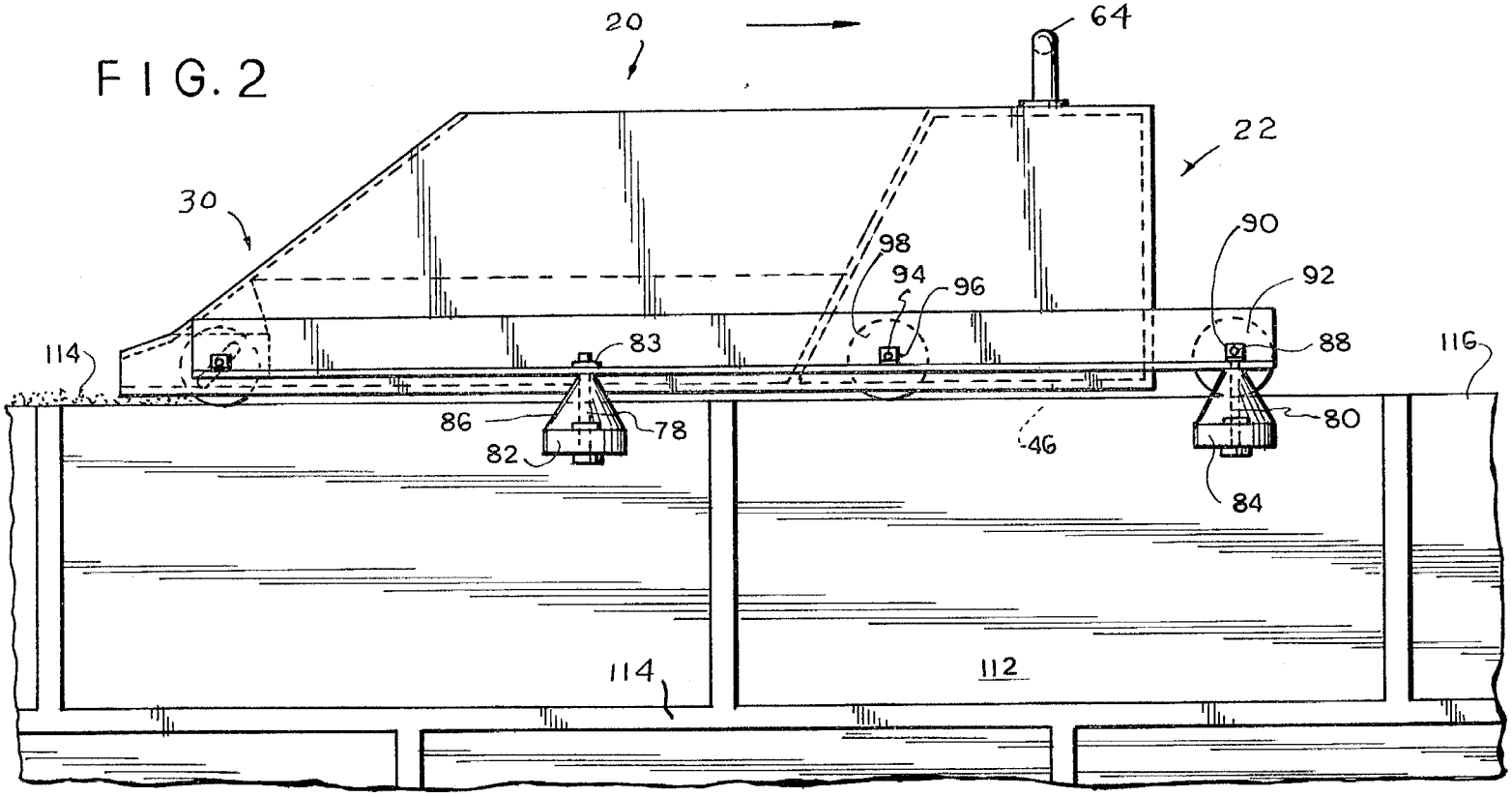
FIG. 2 is a side elevation view of the applicator applying mortar to a building structure formed of concrete blocks.
Figure 3:
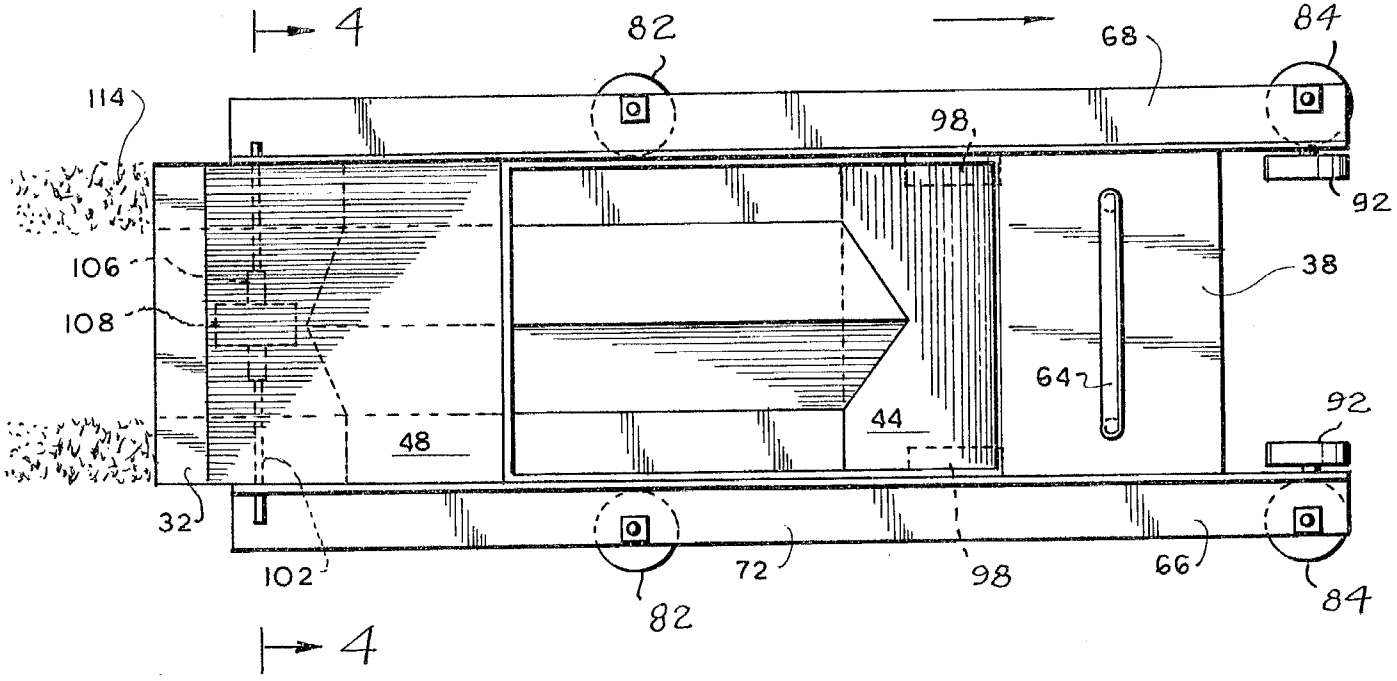
FIG. 3 is a top plan view of the applicator of the invention.
Figure 4:
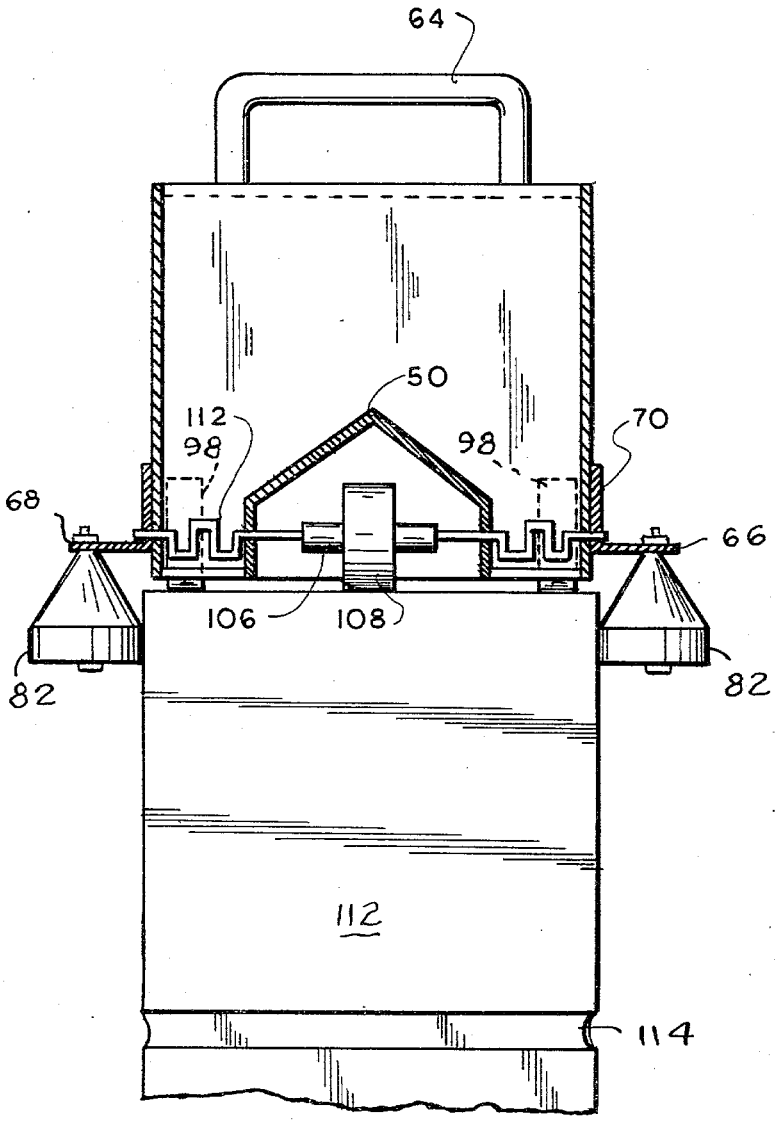
FIG. 4 is a sectional end view thereof taken along the plane of line 4—4 of FIG. 3.
Figure 5:
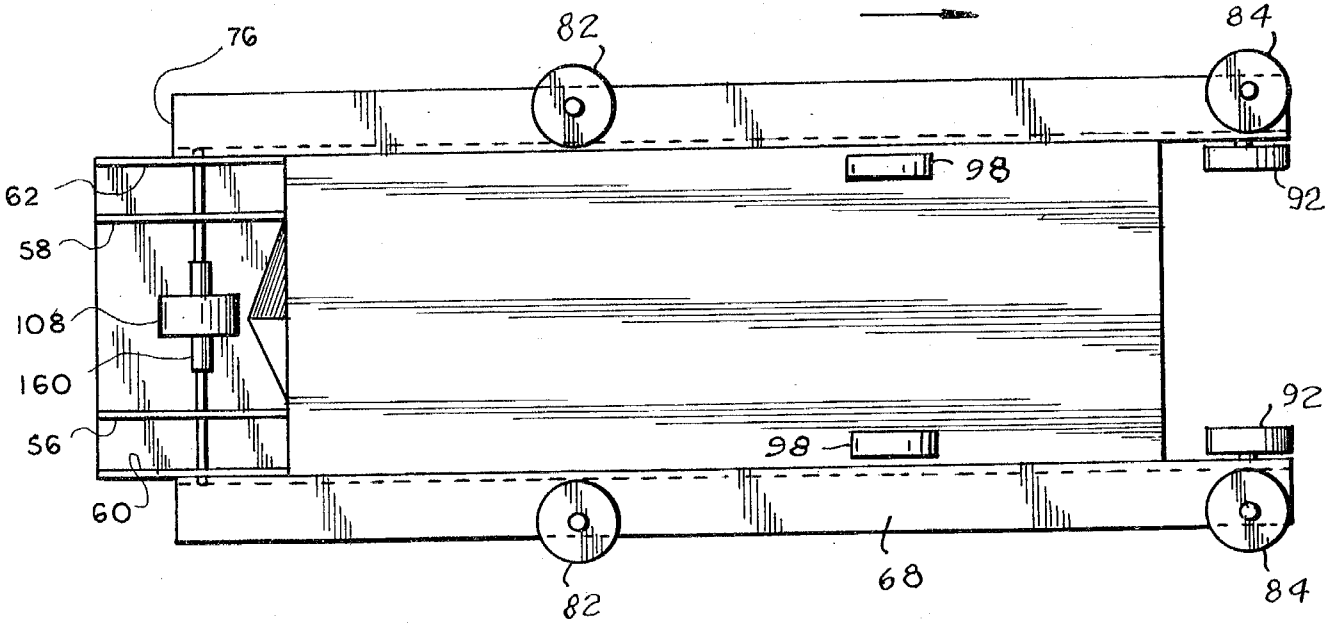
FIG. 5 is a bottom plan view of the applicator of the invention.

In use, applicator 20 is filled with a building material, for example, mortar through opening 40 in its upper end to fill or partially fill chamber 42. The applicator is then grasped in a convenient manner such as by grasping handle 64 and placed onto the building surface for application of the mortar. In the depicted embodiment, a building surface formed of an arrangement of stacked rows of concrete blocks 112 is being utilized. The interstices between the blocks 112 are filled with mortar 114 to bond and hold the blocks together and form a structure such as a foundation or wall. The upper exposed surface of the last formed row of blocks provides the working surface 116 for application of the mortar 114 from applicator 20. The applicator is designed so that each pair of guide rollers 82 and 84 are spaced slightly wider than the width of the row of blocks 112. Suitable adjustment means can be provided to accommodate a variety of width blocks. By preadjustment, the applicator is quickly indexed on the blocks by placing the applicator down with the blocks positioned between the guide wheels 82 and 84 as shown in FIG. 2. The applicator is fully seated so that runner wheels 92 and 98 engage with the work surface 116 along with beater wheel 108. Handle 64 is then grasped along with any other desired portion of the applicator and the applicator is moved along surface 116 in the direction of the arrow of FIG. 2. As this movement occurs mortar 114, directed by the divider blade 48 will move into channels 60 and 62. Thereafter encouraged by periodic contact from beater paddles 110 and 112, the mortar 114 will by uniformly distibuted in a pair of spaced strips along work surface 16 as it exits from channels 60 and 62 during longitudinal movement of applicator 20. In this manner, mortar is automatically applied in a uniform manner in desired amounts along the work surface as the applicator is moved. At the end of the surface 116 which is the end of the upper row of blocks 112 the applicator can be easily lifted from the work surface and a row of blocks placed on work surface 116 where mortar distributed through channels 60 and 62 will bind the next row or blocks in position. A constant amount of mortar is provided in this manner through the work surface in the desired amount and distribution. Thus, there is no waste of mortar or need for further use of tools or implements to redistribute mortar or remove or add mortar. The job can proceed more efficiently with labor and material savings resulting therefrom.

Thus, the applicator 20 of the present invention provides a device for buttering concrete block by applying mortar in a more efficient and economical way. Mortar waste material occurring with manual application is eliminated. Applicator 20 can be formed of any inexpensive conventional material such as a metal or plastic, for example ⅛ inch sheet aluminum. Corrosion or rust resistant material is desirable. The structure can be formed of a welded construction with closed seams, smooth and polished. The various wheels can be conventional metal or plastic. It has been found effective to form the wheel of the beater assembly of rubber material. The applicator is lightweight and thus easy to handle and manipulate during use adding to its efficiency.

Figure 6:
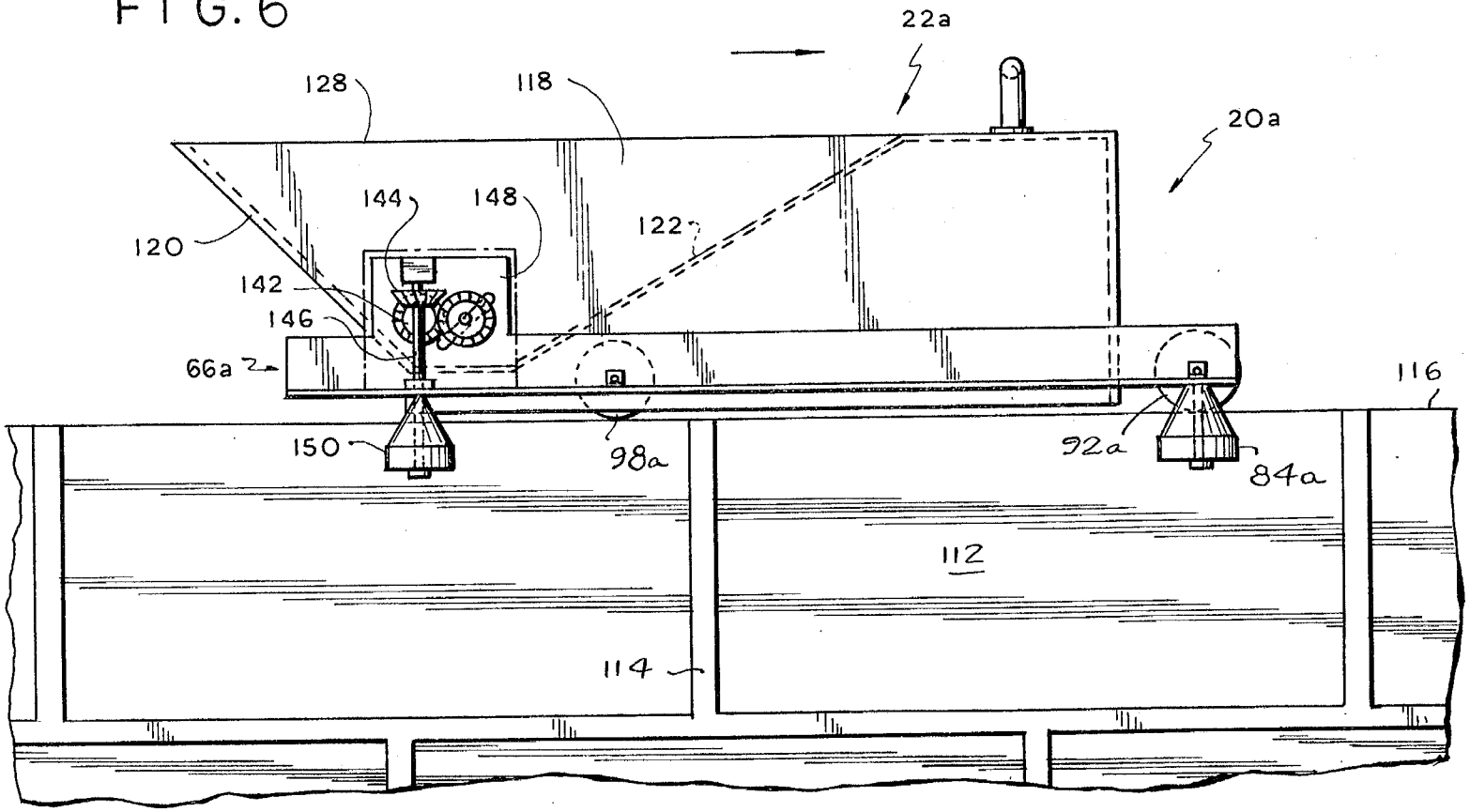
FIG. 6 is a side elevation view of an alternative embodiment of the applicator applying mortar to a building structure formed of concrete blocks.
Figure 7:
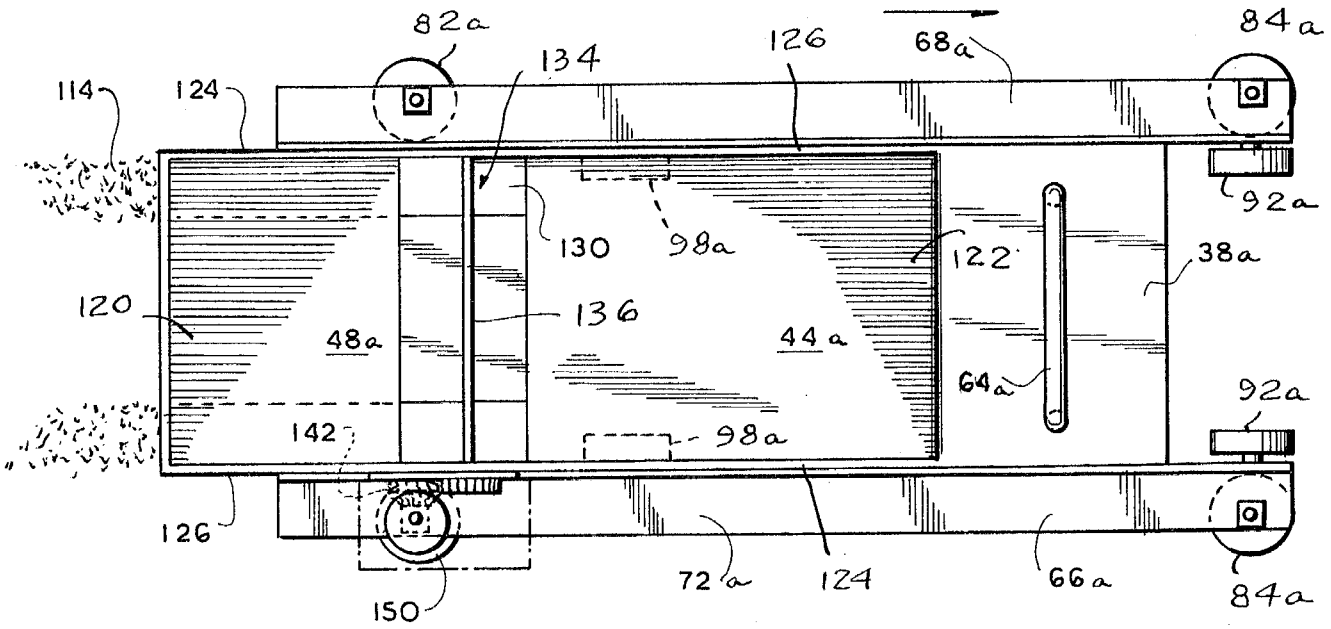
FIG. 7 is a top plan view of the alternative embodiment of the applicator of the invention.
Figure 8:
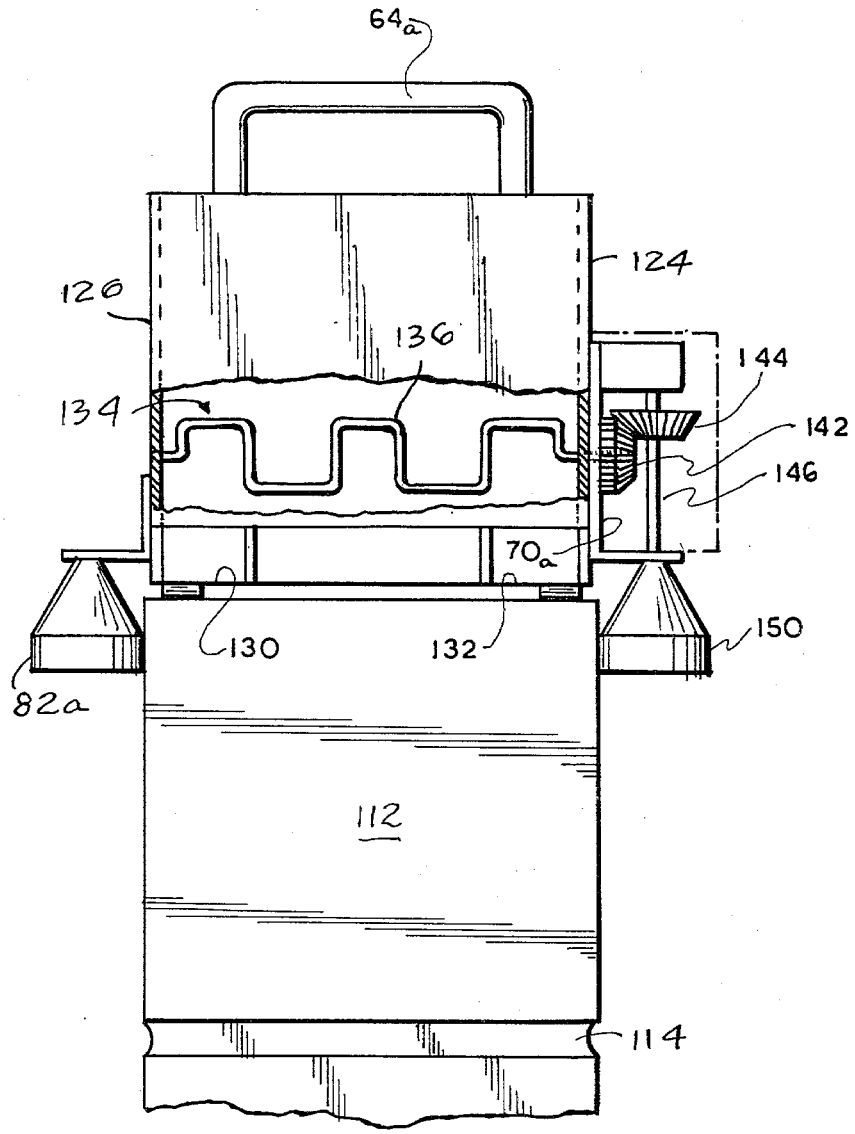
FIG. 8 is a partially sectional end elevation view of the alternate embodiment of the applicator of the invention.

An alternative embodiment of applicator **20*a* is depicted in FIGS. 6–8. In most respects it operates the same and is structured the same as applicator 20. Modifications are present in respect to the chamber for housing the building material and the beater means for metering the building material from the chamber onto the building surface. Similar parts bear similar numbers with the addition of the subscript a. Chamber 118 for containing building material 114 in the housing 22*a* is formed with a pair of opposing end walls 120 and 122 and a pair of opposing side walls 124 and 126. The side walls and end walls are interconnected and converge toward one another from top to bottom. The side walls and end walls form the enclosure for chamber 118 and have a wide opening 128 at the top for insertion of building material. There are two spaced openings 130 and 132 at the bottom for exit of building material 114 from the applicator onto the building surface. Thus the end walls 120 and 122 and the side walls 124 and 126 serve to form a funnel shaped structure for facilitating direction of the building material toward openings 130 and 132** to promote application of the building material.

A modified metering mechanism in the form of a beater assembly 134 is also employed. Beater assembly 134 includes an axle 136 extending across the housing and rotationally mounted at one end to side wall 124 and rotatably extending through an opening in side 126 on the other side of the housing. Axle 136 is bent as it extends across the housing at a number of points to form a series of paddles 138. These paddles form beaters which engage the building material 114 and facilitate its direction through openings 124 and 126 and onto the building surface. The end of beater axle 136 extending through side wall 126 has a beveled gear 140 mounted thereon to rotate therewith. Adjacent to beveled gear 140 and meshed therewith is a second beveled gear 142 rotatably mounted in conventional fashion on the housing. A third beveled gear 144 is positioned perpendicular to bevel gears 140 and 142 and meshes with bevel gear 142. The third bevel gear 144 is mounted on a vertically disposed shaft 146 which is journaled and rotatably mounted on the housing. Shaft 146 extends downward through an opening in L bracket **66*a*. The opening is large enough so that free rotation of shaft 146 is permitted. The upper end of shaft 146 is fixed in position in a conventional manner to the housing within a protective gear box 148. The bottom end of shaft 146 has an enlarged roller 150 mounted thereon. Roller 150 is an elongated roller and is mounted in fixed position on shaft 146 so that as roller 150 rotates shaft 146 rotates. The size of roller 150 is a matter of choice with a larger size roller naturally providing a greater surface engagement with the side walls of the adjacent concrete block when the applicator 20*a*** is positioned on the building surface.

In operation, building material is positioned in chamber 118 and applicator **20*a* is positioned on the building surface in the same manner as the above discussed applicator. Movement of the applicator along the building surface in the direction of the arrow causes roller 150 to rotate which in turn causes shaft 146 and attached bevel gear 144 to rotate. Bevel gear 144 then rotates bevel gears 142 and 140. Rotation of bevel gear 140 rotates axle 136 and paddles 138 to facilitate direction of building material 114 through openings 130 and 132** onto the building surface.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. An applicator for introducing and spreading building material in a controlled manner to a building surface comprising; a housing adapted to contain a predetermined amount of building material therein, guide means on the housing adapted to engage with the building surface and direct the applicator into desired alignment therewith and along a desired path when the applicator is associated with the building surface and moved there along, metering means in communication with the interior of the housing and with at least one opening to the exterior thereof to direct a predetermined pattern of building material from the interior of the housing through the opening and onto the building surface, the housing including a base and an arrangement of side walls extending from the base and forming therewith an enclosure for a chamber to hold building material, the base adapted for engagement with the building surface, the side walls having a configuration when forming the chamber so that building material is directed toward a pair of spaced openings in the base communicating with the building surface when the applicator is positioned thereon, the metering means including a beater on the housing and positioned in the travel path of the building material from the chamber through the openings in the housing, the beater adapted to be actuated when the applicator is moved along the building surface to facilitate metering and direction of building material from the chamber through the openings onto the beater surface, the beater including an axle mounted on the housing, at least one paddle on the axle and positioned in the housing so that rotation of the axle will cause the paddle to rotate and engage and direct building material through the openings onto the building surface, beater drive means on the axle and extending from the housing into direct engagement with the building surface so that movement of the applicator along the building surface will automatically actuate the beater drive means and to rotate the axle and paddle, and the beater drive means including gear means interconnecting the axle with a shaft extending downward from the exterior of the housing into alignment with a guide surface associated with the building surface, a beater roller on the shaft in position for engagement with the guide surface when the applicator is moved along the building surface so as to rotate the interconnected shaft, gear means, axle and paddles.

2. The invention in accordance with claim 1 wherein the building material is mortar and the building surface is the top of at least one of an arrangement of concrete blocks.

3. The invention in accordance with claim 1 wherein a divider blade on the base extending into the chamber and in position to direct building material from the central portion of the chamber toward the pair of spaced openings in the base communicating with the building surface when the applicator is positioned thereon.

4. The invention in accordance with claim 3 wherein a portion of the walls terminate in an open end distal from the base surrounded by a peripheral rim, the open end permitting introduction of building material into the chamber of the housing.

5. The invention in accordance with claim 1 wherein a handle is mounted on the housing for facilitating gripping and movement of the housing along the building surface.

6. The invention in accordance with claim 1 wherein the guide means includes a side bracket on at least one side of the housing in position for alignment with an edge of the building surface, at least one guide wheel extending from each side bracket into position for engagement with guide surfaces associated with said building surface to facilitate proper alignment of the applicator with respect to the building surface and movement of the applicator along the building surface during use.

7. The invention in accordance with claim 6 wherein there is an L-shaped side bracket mounted on the housing parallel to the direction of travel of the applicator in use, one leg of the L-shaped side bracket mounted to the housing and the other leg of the L-shaped side bracket extending laterally therefrom, an axle rod extending downward from the laterally extending leg of the L bracket and the guide wheel rotatably mounted on the axle, a wheel shield on the axle in position to protect the guide wheel.

8. The invention in accordance with claim 7 wherein there are two spaced guide wheels on each L-shaped side bracket with each pair of spaced guide wheels on the side bracket being transversely aligned with the pair of spaced guide wheels on the side bracket on the other side of the housing of the applicator.

9. The invention in accordance with claim 1 wherein at least one runner wheel is rotatably mounted on the applicator and extending downwardly therefrom for engagement with the building surface to facilitate movement of the applicator along the building surface.

10. The invention in accordance with claim 9 wherein there are four runner wheels on the applicator with each wheel being rotatably mounted on an axle extending perpendicular to the direction of travel, each of the four wheels being adjacent to one of the four corners of the rectangularly shaped applicator and extending downwardly therefrom for engagement with the building surface to facilitate movement along the building surface when the applicator is in use.

11. The invention in accordance with claim 3 wherein the divider blade is a V-shaped portion of the base the apex of the V extending into the chamber of the housing and along the direction of travel of the applicator with respect to the building surface, the sloping sides of the V-shaped divider blade extending downward and outward toward the pair of spaced openings, the trailing end portions of the V-shaped divider blades forming end walls substantially parallel to and spaced from adjacent side wall portions of the housing to form a channel therebetween to the openings from the chamber, a paddle on the beater being located in alignment with the channels for each opening respectively to engage and direct building material from the chamber through the channels and out the openings.

12. An applicator for introducing and spreading building material in a controlled manner to a building surface comprising; a housing adapted to contain a predetermined amount of building material therein, guide means on the housing adapted to engage with the building surface and direct the applicator into desired alignment therewith and along a desired path when the applicator is associated with the building surface and moved therealong, metering means in communication with the interior of the housing and with at least one opening to the exterior thereof to direct a predetermined pattern of building material from the interior of the housing through the opening and onto the building surface, the housing including a base and an arrangement of side walls extending from the base and forming therewith an enclosure for a chamber to hold building material, the base adapted for engagement with the building surface, the side walls having a configuration when forming the chamber so that building material is directed toward a pair of spaced openings in the base communicating with the building surface when the applicator is positioned thereon, the metering means including a beater on the housing and positioned in the travel path of the building material from the chamber through the openings in the housing, the beater adapted to be actuated when the applicator is moved along the building surface to facilitate metering and direction of building material from the chamber through the openings onto the beater surface, the beater including an axle mounted on the housing perpendicular to the direction of travel of the applicator, the axle being bent at predetermined points along its length into a configuration forming at least one paddle within the housing positioned so that rotation of the axle will cause the paddles to rotate and engage and direct building material through the openings onto the building surface, beater drive means on the housing connected to the axle and having a portion thereon in engagement with the building surface so that movement of the applicator along the the building surface will actuate the beater drive means to rotate the axle, and the beater drive means includes a first gear mounted on the axle and positioned on the exterior of the housing, a second gear meshed with the first gear and positioned on the housing, a third gear on the housing and meshed with the second gear, the third gear mounted on a vertical shaft extending downward from the exterior of the housing into an alignment with a guide surface associated with the building surface, a beater roller on the shaft in position for engagement with the guide surface when the applicator is moved along the building surface so as to rotate the shaft, the gears, and the axle and paddles.

13. The invention in accordance with claim 12 wherein a beater drive means housing surrounds the three gears of the beater drive means.

14. An applicator for introducing and spreading building material in a controlled manner to a building surface comprising; a housing adapted to contain a predetermined amount of building material therein, guide means on the housing adapted to engage with the building surface and direct the applicator into desired alignment therewith and along a desired path when the applicator is associated with the building surface and moved there along, and metering means in communication with the interior of the housing and with at least one opening to the exterior thereof to direct a predetermined pattern of building material from the interior of the housing through the opening and onto the building surface the housing including a base and an arrangement of side walls extending from the base and forming therewith an enclosure for a chamber to hold building material, the base adapted for engagement with the building surface, the side walls having a configuration when forming the chamber so that building material is directed toward a pair of spaced openings in the base communicating with the building surface when the applicator is positioned thereon, the metering means including a beater on the housing and positioned in the travel path of the building material from the chamber through the openings in the housing, and the beater adapted to be actuated when the applicator is moved along the building surface to facilitate metering and direction of building material from the chamber through the openings onto the beater surface, the beater including an axle mounted on the housing, at least one paddle on the axle and positioned in the housing so that rotation of the axle will cause the paddle to rotate and engage and direct building material through the openings onto the building surface, beater drive means on the axle and extending from the housing into direct engagement with the building surface so that movement of the applicator along the building surface will automatically actuate the beater drive means to rotate the axle and paddle, the axle is mounted on the housing perpendicular to the direction of travel of the applicator, the axle being bent at predetermined points along its length into a configuration to form the at least one paddle, the beater drive means including a wheel on the axle, the wheel extending beyond the base into engagement with the building surface when the applicator is positioned thereon, a pair of paddles on the axle between the ends thereof and having the wheel located therebetween whereby rotation of the wheel in contact with the building surface when the applicator is moved therealong will automatically cause the paddles to rotate and engage and direct building material through the openings onto the building surface.

* * * * *